US006656096B2

(12) United States Patent
Sela

(10) Patent No.: US 6,656,096 B2
(45) Date of Patent: Dec. 2, 2003

(54) EXERCISE METHOD

(76) Inventor: Ilan Sela, 5/2 Dov Hoz Street, Kfar Ganim, Petach Tikva (IL), 49406

( * ) Notice: Subject to any disclaimer, the term of this patent is extended or adjusted under 35 U.S.C. 154(b) by 250 days.

(21) Appl. No.: 09/741,844

(22) Filed: Dec. 22, 2000

(65) Prior Publication Data

US 2001/0019988 A1 Sep. 6, 2001

(30) Foreign Application Priority Data

Dec. 23, 1999 (IL) ..... 133671

(51) Int. Cl.[7] ..... A63B 26/00

(52) U.S. Cl. ..... 482/148; 482/129; 482/908; 482/29; 482/33; 482/38; 473/472; 473/475

(58) Field of Search ..... 482/129, 908, 482/148, 38, 39, 33; 473/472, 479; 273/126 R, 336

(56) References Cited

U.S. PATENT DOCUMENTS 4,161,313 A * 7/1979 Dickey ..... 273/1.5 A

* cited by examiner

*Primary Examiner*—Nicholas D. Lucchesi
*Assistant Examiner*—L Amerson

(57) ABSTRACT

A method for strengthening coordination between a person's hand muscles and muscles of the lower part of a person's body involves (a) the person jumping into the air while holding a hanging article; and (b) placing while in the air the hanging article on an elevated, substantially horizontal flexible support, so that the hanging article is retained on the support after the person releases the article from his hold. The support is positioned above the extended height of the person. An exercise system for strengthening coordination between a person's hand muscles and muscles of the lower part of a person's body thus includes (a) an elevated substantially horizontal flexible support; and (b) a hanging article, wherein the support is positioned above the extended height of the person.

15 Claims, 4 Drawing Sheets

EXERCISE METHOD

FIELD OF THE INVENTION

This invention relates to exercise equipment for improving muscular coordination, and particularly for improving performance in sports.

BACKGROUND OF THE INVENTION

All sports activities require the utilization of various muscles in the body. Different types of actions require the activation of different sets of muscles. In addition, different types of movement require different types of muscular activity. As is well known, muscles alternate between contracted and relaxed states. Certain actions may simultaneously require contraction of some muscles and relaxation of others. For example, in the sport of basketball, inserting the ball into the basket may include a powerful vaulting movement of the legs, which involves muscle contraction, and a precise placing movement with the hands, which involves muscle relaxation. In another example, one hand may dribble the ball, which requires dexterity (muscle relaxation), while the other may push away a competing player, which requires power (muscle contraction).

The simultaneous combination of contraction and relaxation of different muscles is a complex operation which requires extended training in order to perfect. Both the brain and the nervous system must be trained to perform optimally in a dual fashion.

The use of training aids in sports is well known. Examples of such aids include: (1) tying a parachute to a running person in order to improve running skills; (2) attaching two people together by a detachable connector to improve agility and response time; and (3) dribbling a non-uniformly shaped ball to improve response ability. However, training aids for developing differentiation as described above are currently unavailable.

SUMMARY OF THE INVENTION

It is an object of the present invention to provide a method for training a person to perform different types of muscular operations simultaneously and in a coordinated fashion.

It is also an object of the present invention to provide an exercise system in which the method of the invention may be carried out.

In one aspect of the invention, there is provided a method for strengthening coordination between a person's hand muscles and muscles of the lower part of a person's body comprising:

(1) the person jumping into the air while holding a hanging article; and (2) the person placing, while in the air, the hanging article on an elevated, substantially horizontal flexible support, so that the hanging article is retained on the support after the person releases the article from his hold, wherein the support is positioned above the extended height of the person.

In a second aspect of the invention, there is provided an exercise system for strengthening coordination between a person's hand muscles and muscles of the lower part of a person's body comprising:

(1) an elevated substantially horizontal flexible support; and (2) a hanging article;

wherein the support is positioned above the extended height of the person.

In the present specification, the term "hand muscles" includes all muscles controlling hand and finger movement and tension, including those of the arm and shoulder, and the term "muscles of the lower part of a person's body" includes all muscles controlling running, pivoting and jumping movements.

The method of the invention combines two different types of actions employing two different muscular activities. The jumping action involves muscular contraction while the placing action involves muscular relaxation. In this respect, the method resembles the actions required in the game of basketball. However, the method differs from basketball in the use of a support which is flexible. The flexibility of the support enables the trainer to ascertain whether the trainee placed the hanging article on the support in a relaxed manner.

If the muscles involved in the placing action are relaxed, the trainee will immediately release the hanging article from his hold after placing it on the support. Thus, the article will be retained on the support. On the other hand, if the relevant muscles are contracted, the trainee will not promptly release the article, and the downward movement of the trainee together with the flexibility of the support will cause the article to slide off the support.

In the present specification, the term "extended height" when used with respect to a person standing on a level surface with his hand extended vertically above his head, refers to the distance from the level surface to the tip of the extended hand. The term "jump height" is defined as the height which a person can jump above a level surface (i.e. the distance between the level surface and the sole of the person's shoe).

A hanging article is any article which may be placed on the support without falling off, and includes articles which rest on the support rather than hang from it.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF PREFERRED EMBODIMENTS

Figure 1:
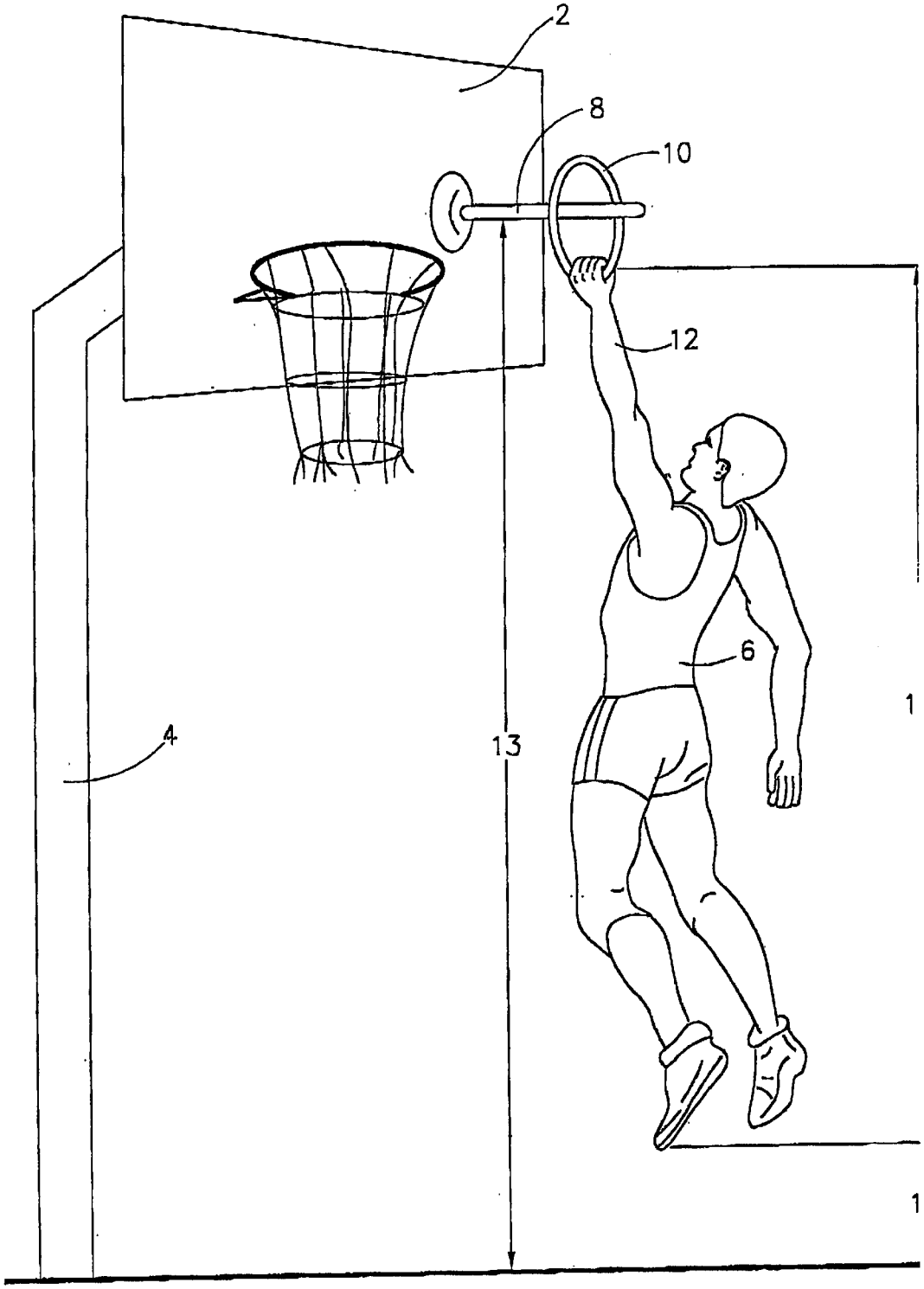
FIG. 1 is a schematic illustration of one embodiment of the method of the invention.

The invention will be more easily understood with reference to FIG. 1, which shows a basketball backboard 2 supported on a vertical backboard support 4, and a person 6 jumping up into the air. A horizontally positioned, flexible support 8 is fixed to the surface of the backboard 2. The person is holding a hanging article 10 in his left hand 12, and is placing the article on the support. If the person is successful in properly placing the article on the support and immediately releasing it, the article will be retained on the support and not fall off it.

It may be seen from FIG. 1 that the support is positioned above the extended height of the person. The exact height 13 of the support will depend upon several parameters, such as: (1) the extended height 14 of the person; (2) the person's jump height 16; and (3) the training state of the person.

The extended height and jump height of a person are as defined above. The average jump height of a sportsman is approximately 45 cm, while the jump height of a well-trained sportsman may reach 75 cm. Initially, the support is placed a short distance above the extended height. As training proceeds, the distance may gradually be increased. Generally, the support will be placed 20–80 cm above the extended height.

For example, a person having a height of 175 cm and an extended height of 210 cm has a jump height of 50 cm. At the beginning of training, the support will be placed at a height of 240 cm. As the person's performance improves, the support may be raised to 260 cm.

The jumping action may be either vertically (straight up) or a combination of vertically and horizontally (e.g. forwards or backwards), depending on the difficulty required of the trainee.

Figure 2A:
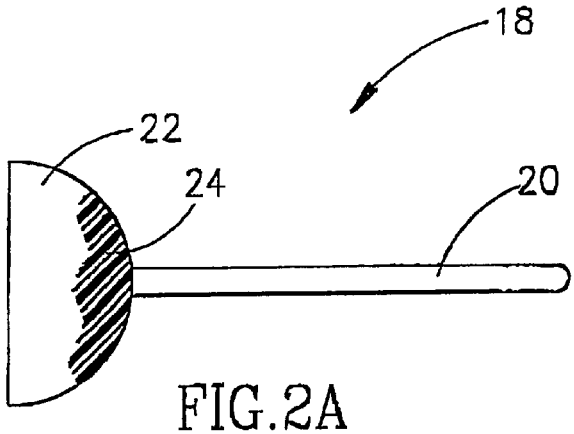
FIGS. 2A, 2B and 2C are side sectional views of various embodiments of the support which may be used in the method of the invention.
Figure 2B:
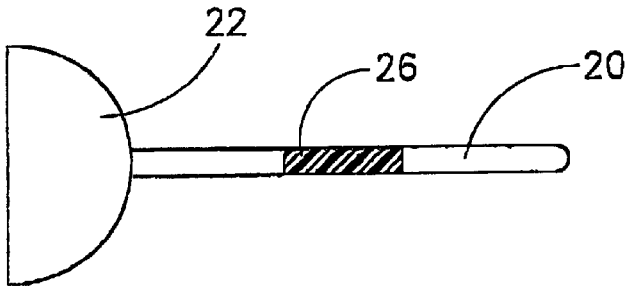
Figure 2C:
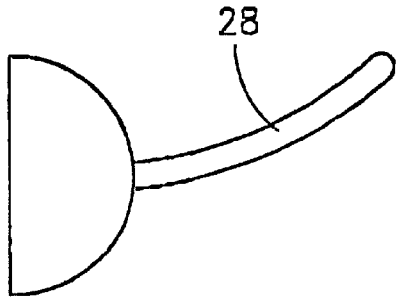

Examples of supports which may be used in the method of the invention are illustrated in FIGS. 2A–2C. The support 18 in FIG. 2A comprises a bar 20 attached to a coupling means 22 for fixing the support to a stationary surface. The coupling means in FIGS. 2A–2C is in the form of a rubber half-sphere such as is found in a plunger for releasing sewage blockages in a sink or toilet, so that the support may be reversibly attached to a surface by vacuum force. However, it will be clear to the average skilled man of the art that other forms of coupling means, both reversible as well as permanent, may be used, such as screws, etc. The coupling means should be capable of fixing the support to the stationary surface in a sufficiently stable attachment so that the support does not fall off the surface during use.

The flexibility of the support may be imparted in several ways. In the embodiment of FIG. 2A, the coupling means 22 has a flexible area 24 at the point of attachment of the bar to it. In the embodiment illustrated in FIG. 2B, the bar 20 has a flexible segment 26 inserted at a position along its length. Other variations will be obvious to the skilled man of the art.

In the embodiment illustrated in FIG. 2C, the bar 28 is curved slightly upwardly. This is intended to facilitate the retention of the hanging article on the support, during an early stage of training.

Figure 3:
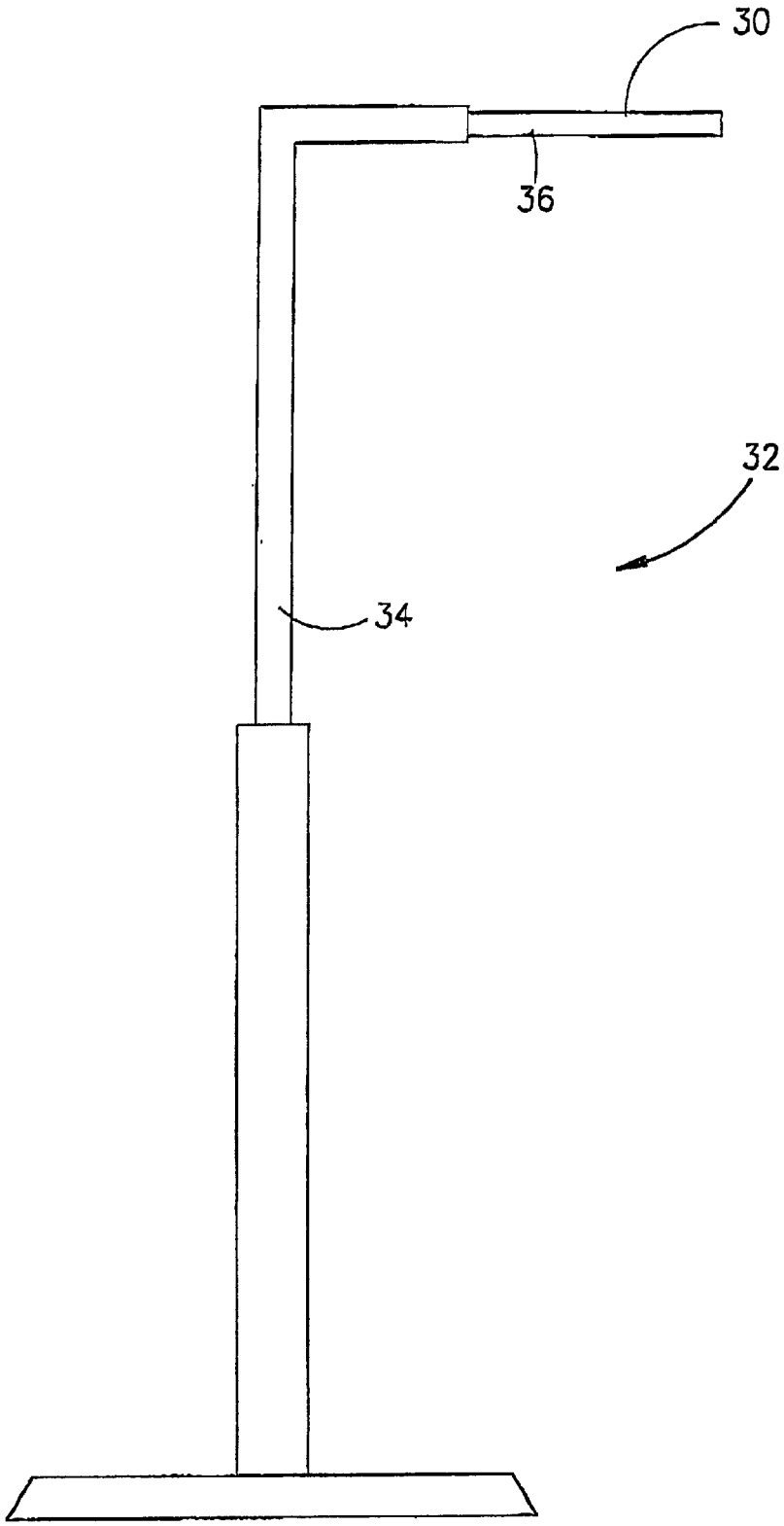
FIG. 3 is a side, sectional view of a further embodiment of the support which may be used in the method of the invention.

A further embodiment of the support is illustrated in FIG. 3 in which the support 30 is mounted on a vertical stand 32. The stand may comprise telescopically movable parts 34 & 36, so that both the height of the stand and the extension of the support may be adjusted.

The afore described embodiments are only examples of types of supports which may be used in the method of the invention. Other examples include a second person simply holding a flexible bar at the required height.

Figure 4A:
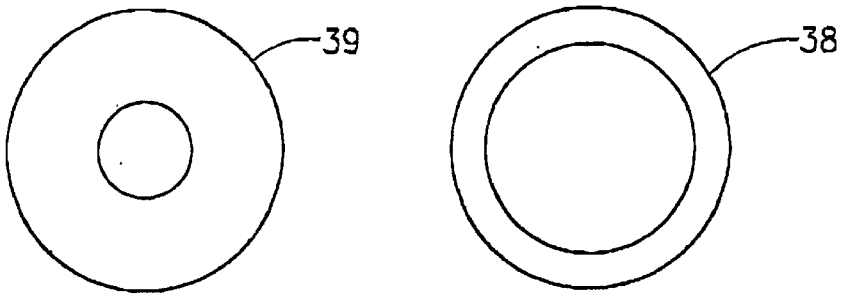
FIGS. 4A, 4B and 4C are side sectional views of various embodiments of the hanging article which may be used in the method of the invention.
Figure 4B:
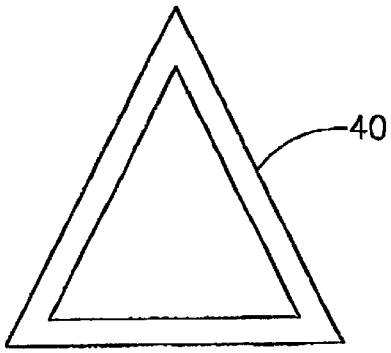
Figure 4C:
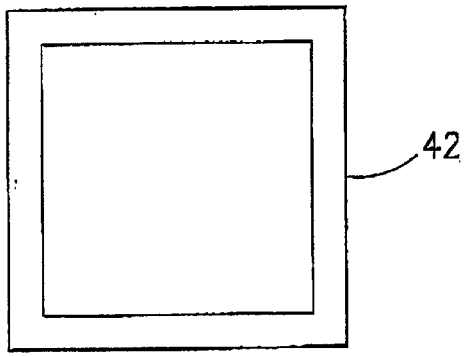

FIGS. 4A–4C illustrate types of hanging articles which may be used in the invention. These include a ring 38 (FIG. 4A), a triangle 40 (FIG. 4B) and a square 42 (FIG. 4C). However, any article which may be grasped by a person and hung on the support is included within the scope of the invention. Changing the weight and shape of the hanging article may vary the difficulty of the exercise. For example, a heavier article will increase the difficulty in successfully hanging it on the support. In addition, the inner diameter of the article may be varied, as illustrated by the ring 39 in FIG. 4A.

Other combinations of hanging article and support may be used in the invention. For example, two parallel horizontal bars may be used as a support, with the hanging article being a ball which must be placed on the bars without falling off.

Further modifications and embodiments of the invention will become apparent to the skilled man of the art from the above description. However, the scope of the invention is to be determined solely by the following claims.

What is claimed is:

1. A method for strengthening coordination between a person's hand muscles and muscles of the lower part of a person's body comprising:

(a) the person jumping into the air while holding a hanging articles; and (b) placing while in the air said hanging article on an elevated, substantially horizontal flexible support, so that said hanging article is retained in said support after the person releases said article for his hold, wherein said support is positioned above the extended height of a person.

2. A method according to claim 1 wherein said support has a coupling means for fixing it to a stationary surface.

3. A method according to claim 2 wherein said coupling means is held by a vacuum force to said stationary surface.

4. A method according to claim 1 wherein said support is attached to a vertical stand.

5. A method according to claim 4 wherein said stand comprises telescopically movable parts.

6. A method according to claim 1 wherein said support is a bar.

7. A method according to claim 2 wherein the flexibility of said support resides in said coupling means.

8. A method according to claim 2 wherein the flexibility of said support resides in the support.

9. A method according to claim 1 wherein said support is curved upwardly.

10. A method according to claim 1 wherein said support is placed at a distance within the range of 20–80 cm above the extended height of the person lumping.

11. A method according to claim 1 wherein said hanging article is selected from the group consisting of a ring, a triangle and a square.

12. An exercise system for strengthening coordination between a person's hand muscles and muscles of the lower part of a person's body comprising:

(a) an elevated substantially horizontal flexible support; and (b) a hanging article;

wherein said support has a coupling means for fixing it to a stationary surface.

13. A system according to claim 12 wherein said coupling emans is held by a vacuum force to said stationary surface.

14. An exercise system for strengthening coordination between a person's hand muscles and muscles of the lower part of a person's body comprising:

(a) an elevated substantially horizontal flexible support; and (b) a hanging article;

wherein said support is adapted to be positioned above the extended height of the person for whom the system is to be set up, and wherein the flexibility of said support resides in said coupling means.

15. An exercise system for strengthening coordination between a person's hand muscles and muscles of the lower part of a person's body comprising:

(a) an elevated substantially horizontal flexible support; and (b) a hanging article;

wherein said support is curved upwardly, and is adapted to be positioned above the extended height of the person for whom the system is to be set up.

* * * * *